US010238227B1

(12) United States Patent
Burke et al.

(10) Patent No.: US 10,238,227 B1
(45) Date of Patent: Mar. 26, 2019

(54) HARVESTED TREE RESERVOIR

(71) Applicants: Caroline Burke, Bethesd, MD (US); Malcolm Burke, Bethesda, MD (US); Courtney Burke, Bethesda, MD (US)

(72) Inventors: Caroline Burke, Bethesd, MD (US); Malcolm Burke, Bethesda, MD (US); Courtney Burke, Bethesda, MD (US)

( * ) Notice: Subject to any disclaimer, the term of this patent is extended or adjusted under 35 U.S.C. 154(b) by 0 days.

(21) Appl. No.: 15/828,711

(22) Filed: Dec. 1, 2017

(51) Int. Cl.
*A47G 33/00* (2006.01)
*A47G 33/12* (2006.01)

(52) U.S. Cl.
CPC ..... *A47G 33/12* (2013.01); *A47G 2033/1286* (2013.01)

(58) Field of Classification Search
CPC .. A47G 33/12; A47G 2033/1286; A47G 7/00; A47G 7/07; A47G 7/02; A47G 7/03; E04H 12/2238; E04H 12/2246
USPC ..... 47/40.5, 48.5, 57.5, 79, 32.4, 32.5, 32.6
See application file for complete search history.

(56) References Cited

U.S. PATENT DOCUMENTS 2,980,377 A * 4/1961 Nielsen ..... A47G 33/12 248/146
3,469,342 A * 9/1969 Morris ..... A47G 33/12 248/188.7
3,769,748 A * 11/1973 Goldring ..... A01G 27/04 116/227
3,794,279 A * 2/1974 Kramer ..... E04H 12/2246 248/160
4,980,991 A * 1/1991 Kipnees ..... A01G 13/0237 47/2
5,035,078 A * 7/1991 Kipnees ..... A01G 13/0237 47/29.1
5,086,583 A * 2/1992 Breen ..... A47G 33/12 206/524
5,779,215 A * 7/1998 DeMasi ..... A47G 33/12 248/523
5,921,025 A * 7/1999 Smith ..... A01G 27/06 47/48.5
6,129,325 A * 10/2000 Niklas ..... A47G 33/12 248/516
6,299,124 B1 * 10/2001 Reback ..... A47G 33/12 248/519
6,827,321 B1 * 12/2004 Murren ..... A47G 33/12 248/519

(Continued)

*Primary Examiner* — Tien Q Dinh
*Assistant Examiner* — Ebony E Evans
(74) *Attorney, Agent, or Firm* — Browdy and Neimark, P.L.L.C.

(57) ABSTRACT

A harvested tree reservoir made from a durable and impermeable material that mounts on the trunk of a harvested tree by inserting the cut end of the harvested tree trunk therein and engaging one or more sealing devices around the circumference of the tree trunk to create a water-tight or spill-resistant seal. The reservoir may then be filled with liquid through one or more ports located on the sides or bottom of the reservoir, with one or more ports having a connector hose. When the reservoir is filled, the tree may be transported, stored, and displayed with minimal spillage of the contents of the reservoir. Additionally, the reservoir may be re-filled, from time to time, through the ports. The reservoir may also be connected, via the connector hose, to one or more other reservoirs to allow for contemporaneous filling or refilling of a plurality of reservoirs in a series.

7 Claims, 10 Drawing Sheets

(56) References Cited

U.S. PATENT DOCUMENTS

| | | | | |
|---|---|---|---|---|
| 8,166,702 | B1 * | 5/2012 | Laface | A47G 33/12<br>47/40.5 |
| 9,375,109 | B2 * | 6/2016 | Hammond | A47G 33/1226 |
| 2002/0108301 | A1 * | 8/2002 | Tasker | A01G 27/005<br>47/40.5 |
| 2005/0230593 | A1 * | 10/2005 | Wynn | A47G 33/12<br>248/523 |
| 2012/0235012 | A1 * | 9/2012 | Andrassy | A47G 33/12<br>248/523 |
| 2017/0188527 | A1 * | 7/2017 | Gordon | A01G 22/00 |

* cited by examiner

HARVESTED TREE RESERVOIR

FIELD

The present teachings relate to liquid reservoirs for harvested trees, and more particularly to a container that facilitates the continual hydration of a cut tree from harvest, through transportation, storage, and display.

BACKGROUND

Christmas trees are typically evergreen conifer trees such as spruce, pine, cypress, or fir which are harvested and displayed in connection with the popular holiday recognizing the birth of Jesus Christ, the savior and redeemer of mankind. Christmas trees are harvested by cutting through the trunk of the tree at a height of anywhere from just off the surface of the ground in which the tree is growing to some other height closer to the top of the tree. It is generally desirable and desired to keep a Christmas tree hydrated as soon as practicable after it is harvested and continually thereafter until eventual disposal of the tree. Continual hydration allows for the harvested tree to maintain a higher moisture content and will cause the tree to retain its needles—in the case of an evergreen tree, or its leaves—in the case of a deciduous tree, for a longer period of time. While many sources advise placing a harvested tree in water as soon as possible after harvesting, there have been very few, if any, attempts to solve the problem of dehydration from harvest through transportation, handling, and storage. For the foregoing reasons, there is a need for a device that can facilitate the hydration of harvested trees.

Presently, there is no known prior art for a sealable and refillable reservoir to provide hydration to cut trees from harvest, through transport, storage, and display. Presently, Christmas trees are harvested in one of two major ways. First, from a commercial forestry or farming operation, where a plurality of trees are cut down and transported, in bulk, to retail sales locations. These are often locations with limited services and facilities, typically vacant lots, parking lots, or the like. The transportation is usually done by rail car, flat-bed trailer, closed or open shipping container, or some combination thereof. At the retail location, trees are typically displayed upright so consumers can inspect them and select a tree they fancy. Also, some trees may remain stacked horizontally as inventory for future display and sale. Once a tree is selected from the lot, it is often packaged in mesh, baling, or wrapping, secured to the roof of a motor vehicle, and transported back to the where the consumer wishes to display the tree, oftentimes in a tree stand that accommodates a small supply of water or other liquid. A second method of harvest is by individual consumers who travel to tree farms to select and harvest their own trees. In this method, after harvest, the trees are often packaged in mesh, baling, or wrapping, secured to the roof of a motor vehicle, and transported back to the where the consumer wishes to display the tree. Oftentimes the tree is displayed in a tree stand that accommodates a small supply of water or other liquid. Under both methods, and in most cases, the display location is within a home or other heated environment that is some distance from the site where the tree is acquired. This prior art is deficient because it allows the harvested tree to dry out or become desiccated after it is harvested, and before is placed in a tree stand with a water or liquid reservoir.

SUMMARY

A non-limiting summary of various embodiments of the present teachings is set forth next.

Various aspects of the present teachings relate to, among other things, a reservoir for a harvested or cut tree. In a variety of embodiments, the reservoir for a harvested or cut tree allows the cut end of the tree trunk to be situated in water or other liquid and may be sealed once the tree trunk is inserted therein so that it is spill-resistant or spill-proof.

In various embodiments, the reservoir for a harvested or cut tree may be filled or refilled with water or other liquid through one or more filling ports, or through a one or more connector hoses. In various embodiments, the reservoir for a harvested or cut tree may be connected, via one or more connector hoses, to another reservoir (which itself may be connected to another reservoir for harvested or cut trees, and so on, and so on) to allow for contemporaneous refilling of multiple reservoirs or containers in a series.

In various embodiments, the reservoir for a harvested or cut tree may serve as a tree stand to mount the tree in an upright or vertical fashion. In various embodiments, the reservoir for a harvested or cut tree may serve as a tree stand to mount the tree in an upright or vertical fashion and which may be refilled using the connector hose, in a manner that is more comfortable to an average-sized human.

In various embodiments, the tree reservoir for a harvested or cut tree with a sealable opening can provide for easier hydration to a harvested tree by utilizing one or more resealable ports on a container whose lower end terminates in a closed space constituting the base, or bottom, of the reservoir or container.

In various embodiments, the reservoir is placed on the tree trunk through the insertion of the tree trunk into the one or more sealable openings of the tree reservoir. Once inserted, the sealable opening may be sealed around the circumference of the tree trunk, compressing a lining of collapsible and impermeable material, such as closed cell foam, against the surface of the tree trunk and thereby forming a watertight seal around the trunk of the tree.

In various embodiments, a plurality of compatible collapsible and impermeable annular-shaped linings are provided, each comprising an inner diameter and an outer diameter; wherein said inside of the one or more openings of the container comprises an inner diameter; wherein said outer diameter of said lining is substantially the same as the inner diameter of said opening; wherein said inner diameter of said linings is configured to pass the trunk of a selected tree; and further wherein said plurality of linings comprises a plurality of different inner diameters for accommodating a plurality of tree trunks of different diameters and horizontal cross sections. Thereafter, water or other liquid may be poured or otherwise delivered into the reservoir through one or more ports, and a stopper or cap placed to obstruct the port opening.

In various embodiments, the inclusion of one or more holes along the neck of the sealable opening of the container will accommodate the insertion of one or more sealant nozzles or straws of the kind common in canned foam insulation or sealant used in the construction industry. This additional foam material may be added to further improve the water-tight seal of the reservoir.

In various embodiments, the tree reservoir may be refilled, from time to time, as water or the liquid is absorbed by the tree, spills, evaporates, or otherwise exits the reservoir. In various embodiments, the tree reservoir further includes one or more permanent or detachable connector hoses on one or more of the ports on the reservoir.

In various embodiments, the tree reservoir may be connected to any number of additional tree reservoirs in a series, or daisy-chain, to allow for the contemporaneous filling of a plurality of tree reservoirs, in series. In various embodiments, caps or plugs for the filling ports and the connector hoses allow for resealing of the filling ports and/or connector hoses after water or other liquid is poured or otherwise delivered into the reservoir or container.

In various embodiments, the tree reservoir may be refilled, when the tree is stood upright or vertically, through the use of the one or more connector hoses. In this manner, a person may refill the reservoir from a greater height off the ground than the location of the reservoir and remain in a position of greater comfort. In various embodiments, the inclusion of antifungal treatment, plant food, or similar additive material within the container of the reservoir to prevent the growth of bacteria, fungi, or other life forms which may be detrimental to the health of the harvested tree, or otherwise beneficial to its health.

These and other features, aspects, and advantages of the various embodiments, will become better understood with reference to the following description, claims, and accompanying drawings.

DESCRIPTION OF VARIOUS EMBODIMENTS

Referring now more particularly to the drawings. While the present teachings will be described in conjunction with various embodiments, it will be understood that they are not intended to limit the present teachings to those embodiments. The present teachings are intended to cover various alternatives, modifications, and equivalents, as will be appreciated by those of skill in the art.

Figure 1:
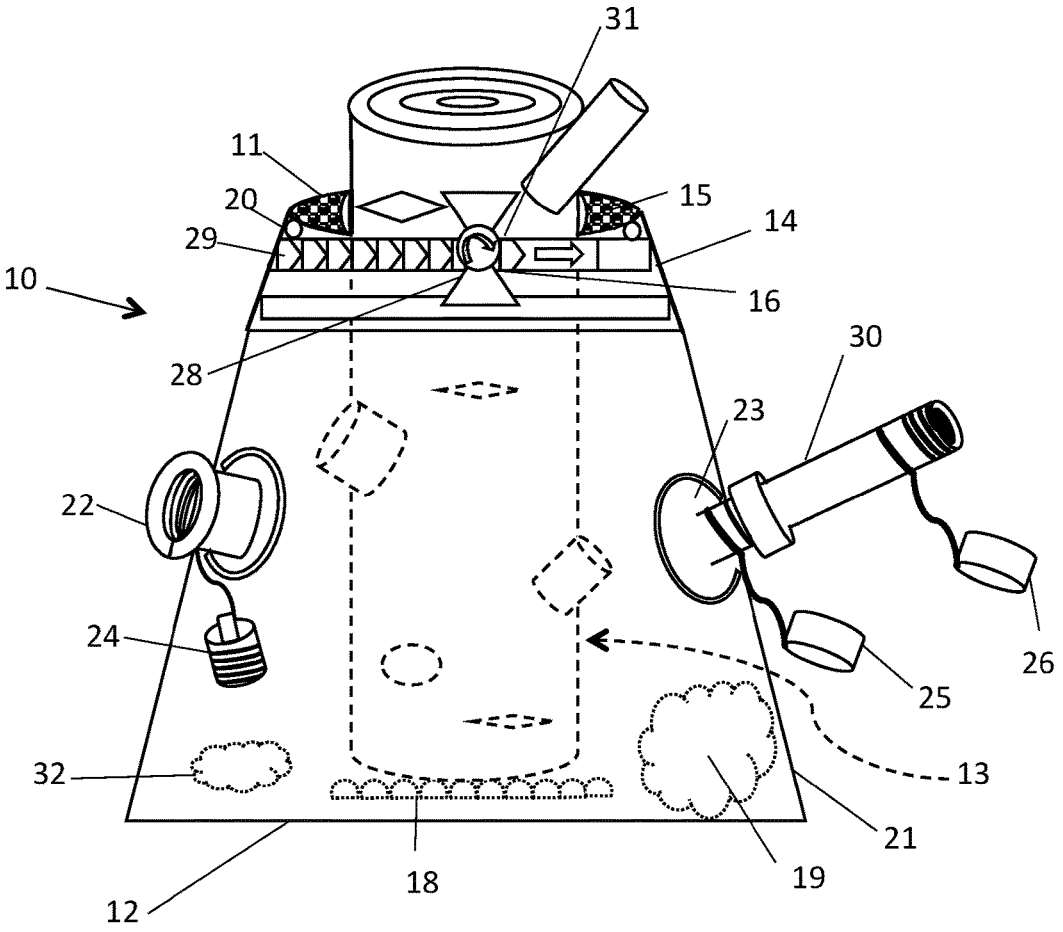
FIG. 1 depicts in schematic form, with portions shown in phantom, a cut tree reservoir having one or more openings with one or more seals with linings of collapsible and impermeable material positioned along the inner circumference of the openings, one or more sealant straw holes, one or more ports with caps or plugs, one or more hoses with caps or plugs, one or more internally positioned ridges, one or more closed cell inserts, and one or more amounts of fungicide or other material, according to various embodiments, as well as a cut tree trunk, a portion of which is shown in phantom.

Referring now to FIG. 1, in accordance with various embodiments, there is shown a cut or harvested tree reservoir formed of a substantially conical container generally indicated by the reference numeral 10, and an opening 11. The container 10 includes a floor 12, and a curved frusto-concical wall portion 21 extending up from the floor 12 and terminating in the opening 11 near its upper end. At the neck 14 of the opening 11 there is one or more sealing devices 16 affixed to or incorporated into the neck 14 of the opening 11 of the container 10. Said sealing device 16 is comprised of one or more handles or dials 28 that, when turned, feed one or more cinching straps 29 through one or more one-way geared closures 31 to effectuate a tourniquet-style sealing action. These sealing devices may be of the tourniquet-style, or hose clamp style, which constrict the opening 11 of the container 10 by the application of rotating force to one or more handles or dials 28 that feed one or more cinching straps 29 through one or more one-way geared closure 31. Applicant intends to encompass any structure presently existing or developed in the future that performs the same or similar sealing function around the circumference of a substantially cylindrical object.

Within the interior portion, or circumference, of the neck 14, of the container 10 there is affixed an amount of collapsible, flexible and impermeable material, such as closed cell foam, 15 such that the cut end of a harvested tree trunk 13 may be inserted into the opening 11 and be surrounded by the collapsible material 15.

The portion 21 has one or more ports 22 for filling and refilling the container 10 and that are closed by a cap or plug 24. The portion 21 also has one or more ports 23 for filling and refilling the container 10 and which are closable by a cap or plug 25 and with a hose 30 which may be affixed thereto which is closable by a cap or plug 26 at the distal end of the hose 30. The container 10 is generally conical and made of a durable, and impermeable material such as plastic, polypropylene, polyethylene film, woven polyethylene, injection-molded vinyl, rubber vinyl, a single plastic sheet folded and welded by known plastic welding techniques, or other material with similar physical characteristics.

The interior floor 12 of the interior cavity of the container 10 has one or more ridges 18 that provide structural integrity to the container 10, allow liquid placed into the container 10 to come in contact with the end of a tree trunk 13 inserted into the container 10, and prevent the tree trunk 13 from abrading or damaging the floor 12 of the container 10.

There is also an amount of closed cell foam 19 placed within the interior cavity of the container 10 to act as a sacrifice should any liquid placed within the container 10 freeze, and the elastic or flexible nature of the container 10 material not expand enough to accommodate the expanding ice. There is also an amount of fungicide, plant food, or other additive 32 placed within the interior cavity of the container to prevent the growth of organisms which may be detrimental to the health of the harvested tree, or otherwise provide material which may be to its benefit.

Also shown in FIG. 1 are one or more holes 20 along the neck 14 of the one or more openings 11 of the container 10 to accommodate the insertion of one or more sealant nozzles or straws of the kind common in canned foam insulation or sealant used in the construction industry.

Figure 2:
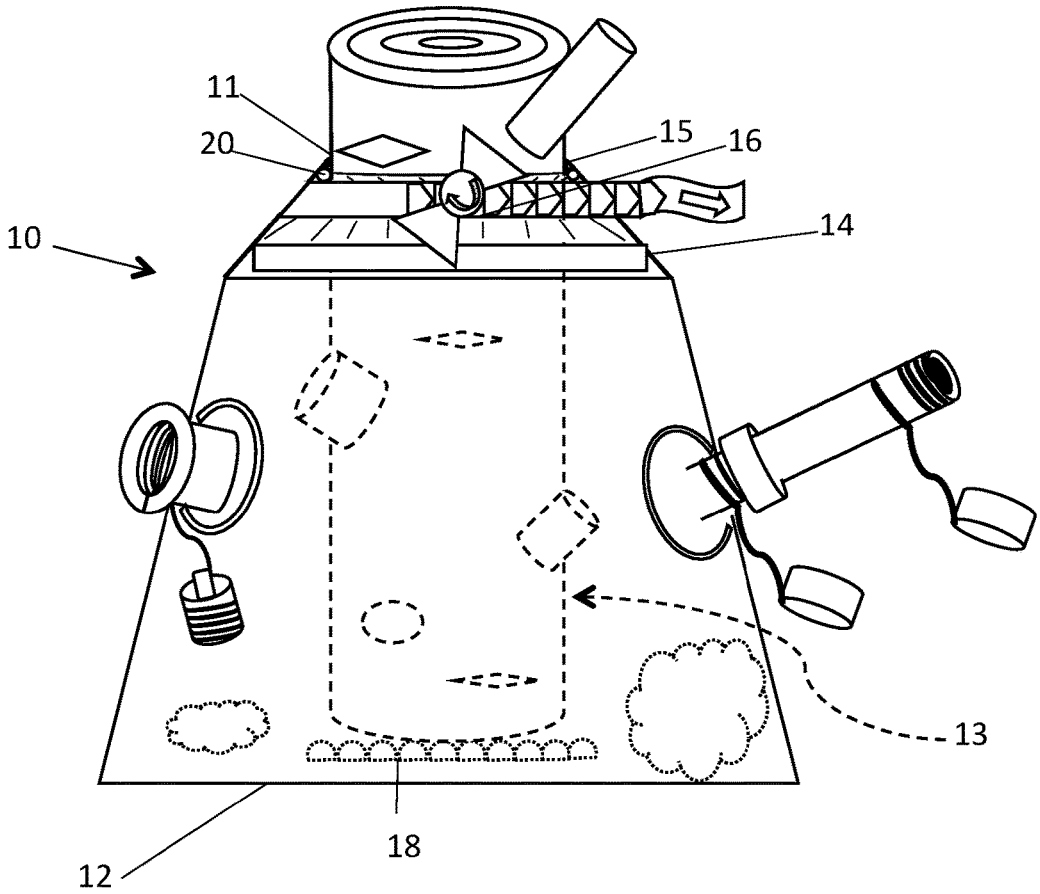
FIG. 2 depicts in schematic form, with portions shown in phantom, the reservoir of FIG. 1 with the sealing device actuated against the circumference of the cut tree trunk, a portion of which is shown in phantom.

As depicted in FIG. 2, the one or more container openings 11 is placed around the cut end of the trunk a harvested tree 13, and the tree trunk 13 is inserted into the container 10 until the end of the tree trunk comes into contact with ridges 18 located on the interior floor 12 of the container 10. The one or more sealing devices 16 that are secured to, or incorporated into, the neck 14 of the opening 11 may now be operated to form a water-tight, or water-resistant seal around the circumference of the tree trunk 13 and provide enough compressive force or pressure against the tree trunk 13 to secure the container 10 to the tree trunk 13. The inclusion of collapsible, flexible and impermeable material, such as closed cell foam, 15, as a bushing or gasket around the inner surface of the neck 14 of the opening 11 allows for a water tight seal to form between the tree trunk 13 and the neck 14 of the container 10 when pressure is applied by the one or more sealing devices 16.

Also shown in FIG. 2, are one or more holes 20 along the neck 14 of the one or more openings 11 of the container 10 to accommodate the insertion of one or more sealant nozzles or straws of the kind common in canned foam insulation or sealant used in the construction industry.

Figure 3:
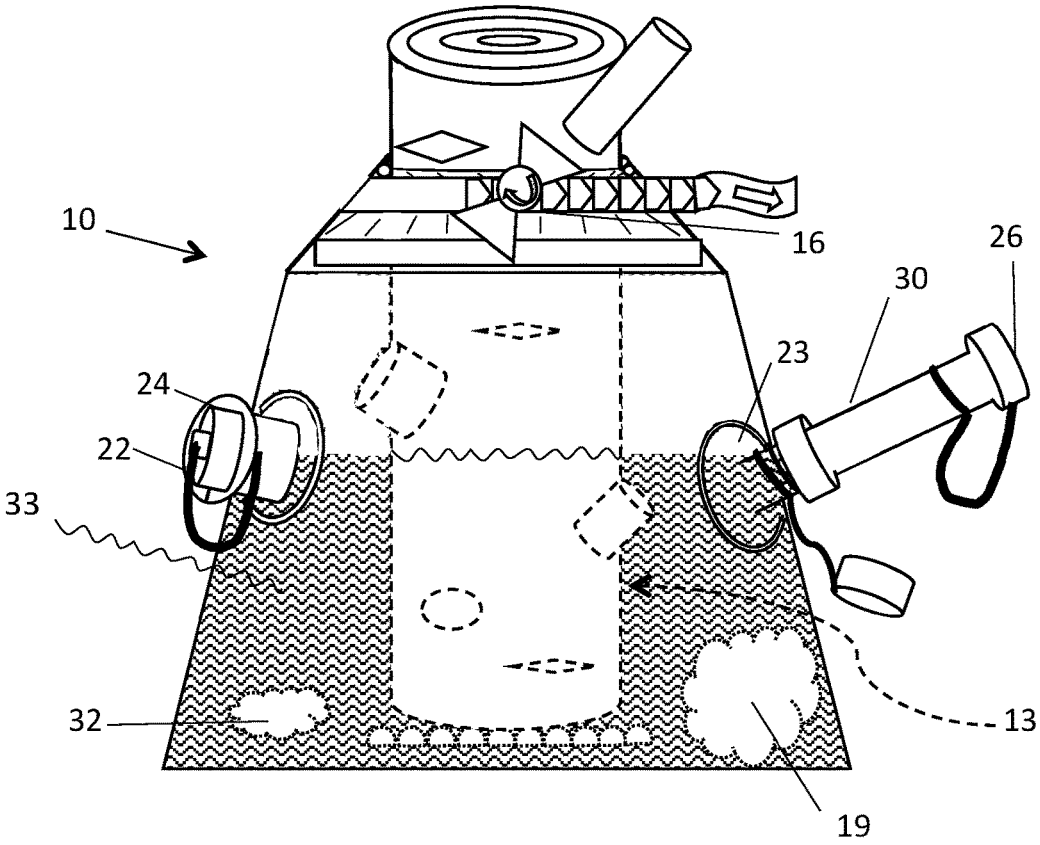
FIG. 3 depicts in schematic form, with portions shown in phantom, the reservoir of FIG. 2 with the reservoir partially filled with liquid, and with the caps and plugs secured within or onto their respective ports thereby creating a water-tight container secured around the harvested tree trunk.

As shown in FIG. 3, once sealed with the sealing device 16, a liquid 33 may be introduced into the container 10 after removing the plug 24 or cap 26 from the one or more ports 22 or 23, to provide hydration and moisture to the tree trunk 13. Refilling would be done as desired, either through the one more ports 22 or 23 or the one or more connector hoses 30. There is also an amount of closed cell foam 19 placed within the interior cavity of the container 10 to act as a sacrifice should the liquid 33 within the reservoir freeze, and the elastic or flexible nature of the container 10 material not expand enough to accommodate the expanding ice. There is also an amount of fungicide, plant food, or other additive 32 placed within the interior cavity of the container to prevent the growth of organisms which may be detrimental to the health of the harvested tree, or otherwise provide material which may be to its benefit.

While the depicted embodiment of FIG. 1 and FIG. 2 show a sealing device 16 that is incorporated or affixed to the neck 14 of the opening 11 of the container 10, it is noted that the sealing function can be accomplished by the use of an annular sealing device, and a compatible reservoir.

In the descriptions that follow, with respect to the figures, components that are like or similar to those described previously will share the same reference numerals.

Figure 4:
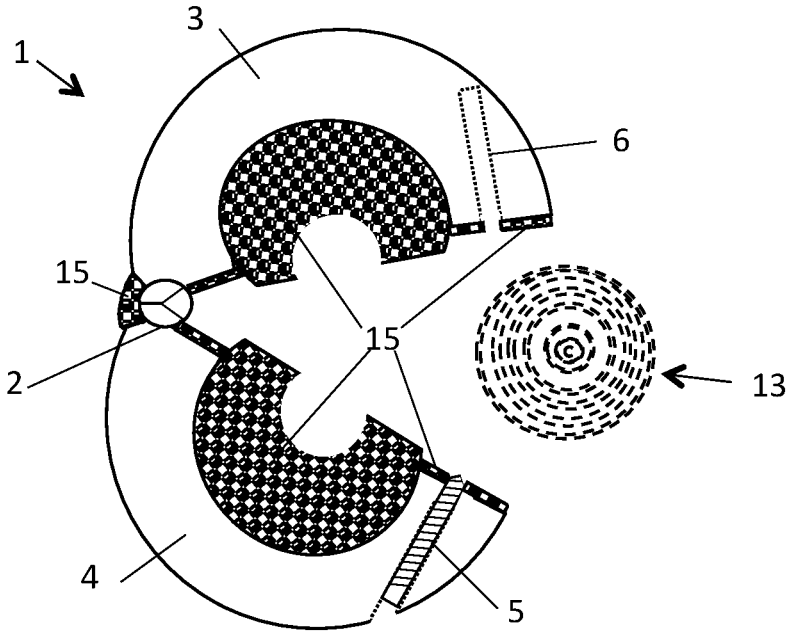
FIG. 4 schematically depicts, in horizontal cross section view along its center-line, an annular sealing device in an open configuration, with its lining of collapsible and impermeable material exposed along the inner circumference of the annular device and the one or more sealing screws and one or more compatible holes for the screws, for use according to various embodiments, as well as a cross sectional view, in phantom, of a tree trunk.

Referring now to FIG. 4 an embodiment of an annular sealing device 1 is illustrated in cross section view with a cross section of a tree trunk 13 in phantom. As with the sealing device shown and described in FIG. 1, the annular sealing device 1 in FIG. 4 includes, within the interior surfaces of its circumference, an amount of collapsible and impermeable material, such as closed cell foam, 15 such that when the annular sealing device 1 is placed around a tree trunk 13 it will surround the tree trunk with the collapsible material 15. The annular sealing device 1 is comprised of two arc-shaped members or arms 3 and 4 connected by a hinge 2 at one end and selectively connected by a screw 5 and corresponding hole 6, on the respective arms, at the other end.

Figure 5:
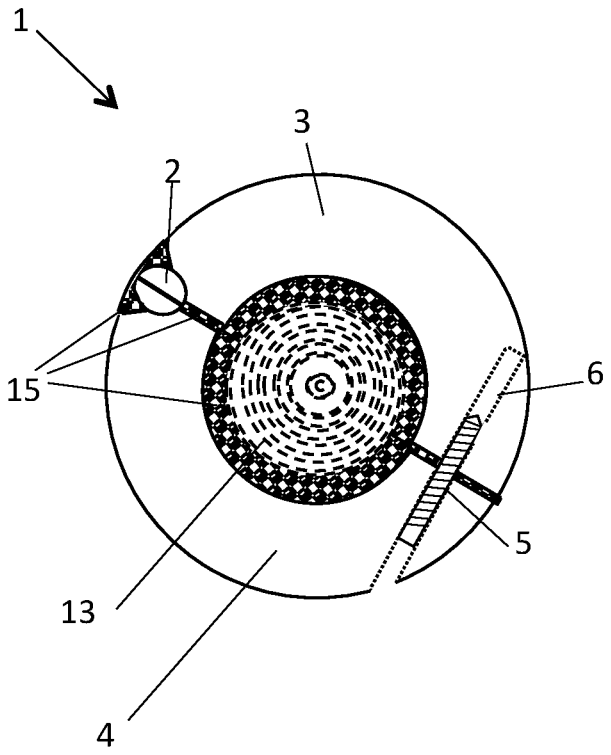
FIG. 5 schematically depicts, in horizontal, cross section view along its center-line, the annular sealing device of FIG. 4 placed around the circumference of a tree trunk, in phantom cross-sectional view, in a closed configuration and sealed tightly against the tree trunk by use of the one or more sealing screws that drives through the two segments of the annular sealing device and the compression of the lining of collapsible and impermeable material on the inner circumference of the annular sealing device against the surface of the tree trunk.

Referring now to FIG. 5, the sealing device 1 of FIG. 4 is illustrated in cross section view secured around a cross section of a tree trunk 13 in phantom. The sealing screw 5 is aligned and screwed into the compatible screw hole 6, which is threaded to accommodate the screw. When the screw 5 is threaded into the screw hole 6, the arms of the device 3 and 4 rotate around the hinge 2, and are forced closed around the trunk of the tree 13 and compress the collapsible, flexible and impermeable material 15 such that a water tight seal is formed between the arms of the sealing device 3 and 4, and the tree trunk 13.

Figure 6:
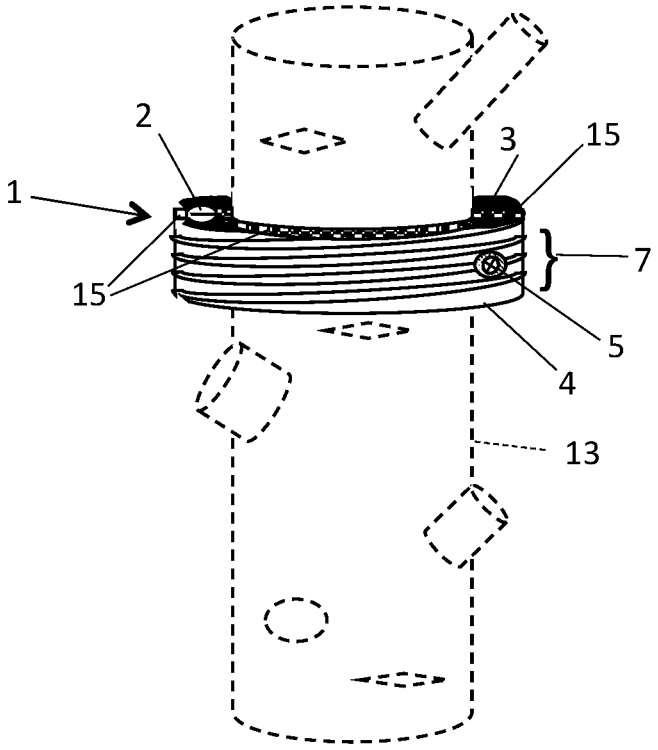
FIG. 6 schematically depicts, with portions shown in phantom, the annular sealing device of FIG. 4 placed around the circumference of a tree trunk in a closed configuration and sealed tightly against the tree trunk with the use of the one or more sealing screws that drive through the two arms of the annular sealing device and create lateral pressure from the lining of collapsible and impermeable material on the interior circumference of the annular sealing device onto the trunk of the cut tree.

Referring now to FIG. 6, the annular sealing device 1 of FIG. 5 is illustrated in schematic view secured around a tree trunk 13 in phantom. The sealing screw 5 is screwed into the screw hole such that the arms of the sealing device 3 and 4 have pivoted on the hinge 2, been drawn closer to the tree trunk 13, and compressed the collapsible and impermeable material 15 such that a water tight seal is formed between the collapsible, flexible and impermeable material 15 and the tree trunk 13. Visible in this view is the surface 7 of the exterior circumference of the annular sealing device 1 which comprises external threads that mate with the internal threads of the harvested tree reservoir.

Figure 7:
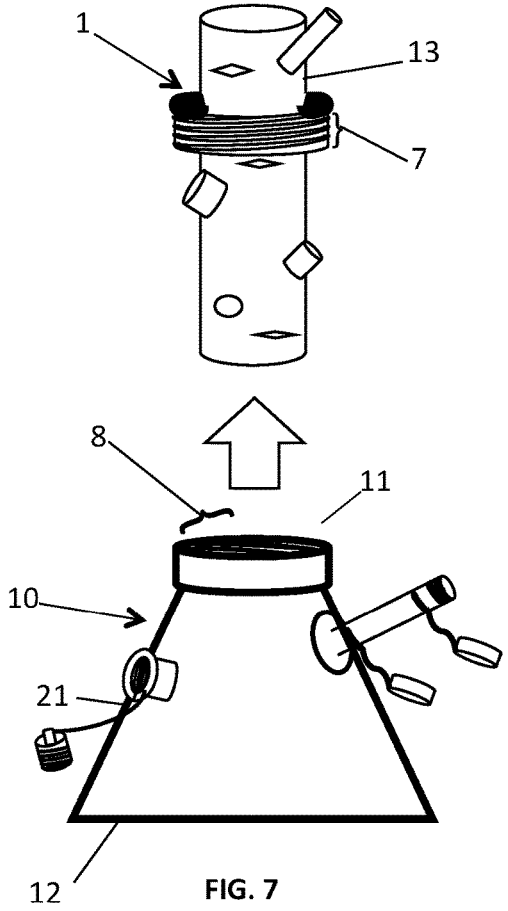
FIG. 7 schematically depicts the annular sealing device of FIG. 4 placed around the circumference of a cut tree trunk in a closed configuration and sealed tightly against the tree trunk, with the surface of the exterior circumference thereof comprising a male threaded member; and, a cut tree reservoir having one or more openings, with interior surface of the opening thereof consisting of a female threaded member compatible to the male threaded member of the annular sealing device, with one or more ports and hoses, according to the various embodiments.
Figure 8:
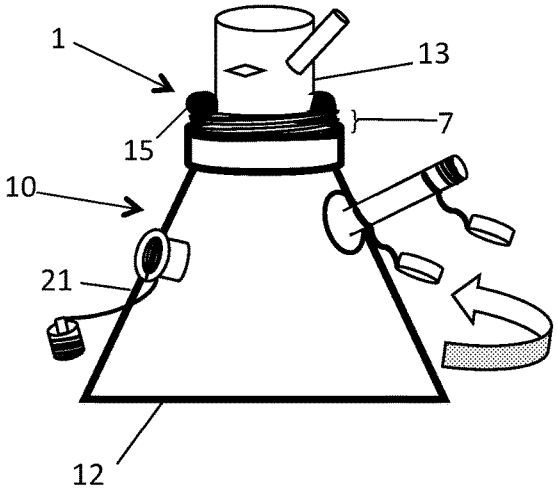
FIG. 8 schematically depicts the annular sealing device of FIG. 4 placed around the circumference of a cut tree trunk in a closed configuration and sealed tightly against the tree trunk, with the surface of the exterior circumference thereof comprising a male threaded member which is partially threaded into the one or more openings of a cut tree reservoir, the opening thereof having an interior circumference comprising a female threaded member compatible to the male threaded member of the annular sealing device, with one or more ports and hoses, according to the various embodiments.

Referring now to FIG. 7 and FIG. 8, which depict in perspective view with some elements in phantom, the installation of a compatible reservoir onto the annular sealing device 1 of FIG. 6, which itself has been attached to the trunk of the tree 13. While the depicted embodiment of FIGS. 1-3 depict a reservoir that includes a sealing device that is incorporated or attached to the neck of the reservoir, the reservoir depicted of FIG. 7 and FIG. 8 is a generally conical container 10 having a floor 12 and side walls 21 tapering upwards to one or more openings 11, wherein the surface of the internal circumference of the opening comprises internal threads 8 that mate with the compatible external threads 7 of the annular sealing device 1. The remaining features and novelties of the reservoir depicted in FIGS. 1-3 obtain to this reservoir, though not enumerated or described herein.

Figure 9:
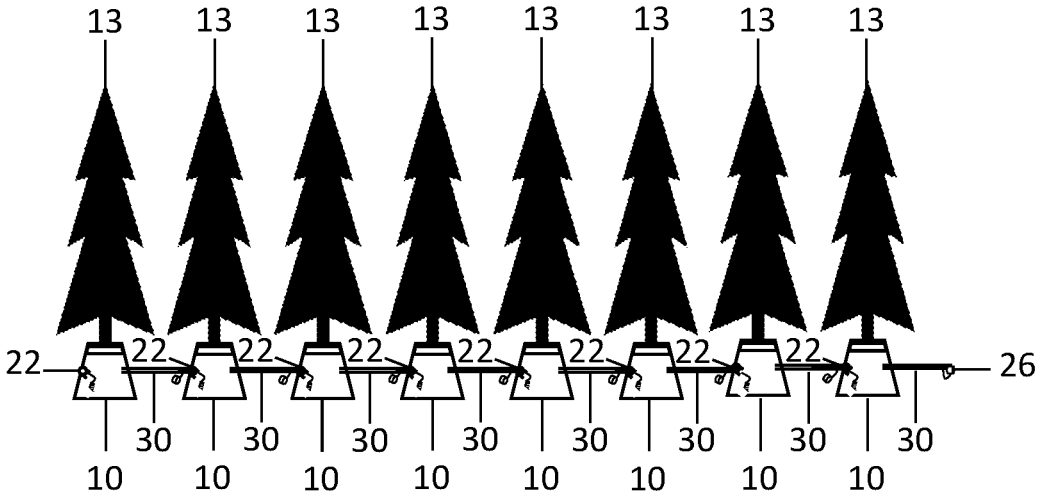
FIG. 9 schematically depicts, a plurality of cut tree reservoirs, each secured to the cut tree trunk of a Christmas tree and, all but the first in the series and the last in the series, connected to two other reservoirs, so that a continuous chain of reservoirs is formed and that the plurality of reservoirs may be filled through a single connection to a service hose at one end of the series, according to various embodiments.

In reference now to FIG. 9, when it is desired to fill a plurality of containers 10 that that have been installed onto a plurality of trees 13 (as when a plurality of trees are harvested and loaded onto a truck for delivery to distant locations) the hose 30 of one container 10 may be connected to the opening 22 of another container 10. A plurality of containers 10 may be connected in this fashion and they may all be filled by attaching a service hose or other means of liquid delivery to the port 22 of the first container in the series and running the hose water or other liquid, until the containers 10 are filled with the desired amount of liquid and the cap 26 to the last hose 30, in the chain may be used to seal that hose 30 closed.

Figure 10:
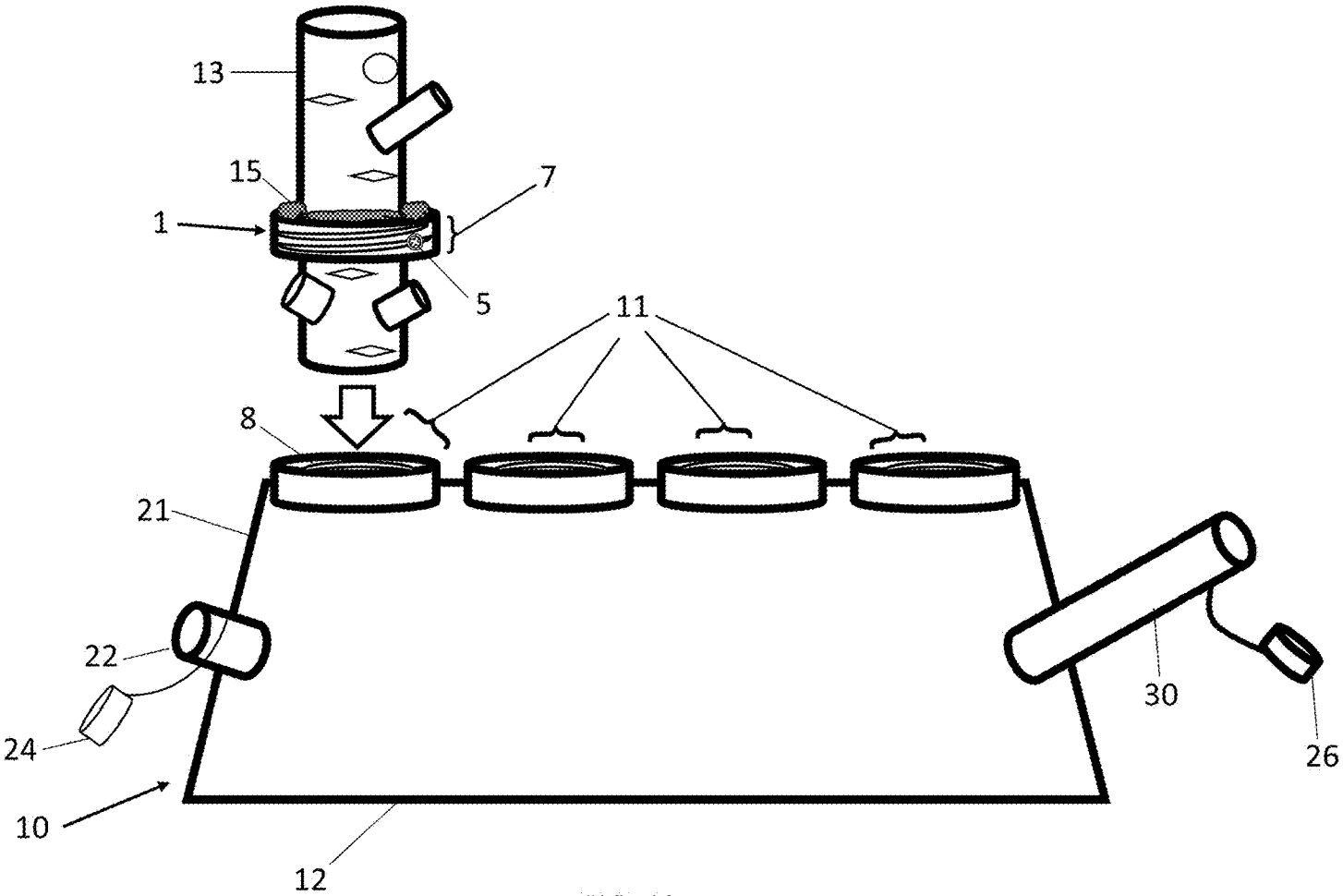
FIG. 10 depicts the annular sealing device of FIG. 4 placed around the circumference of a cut tree trunk in a closed configuration and sealed tightly against the tree trunk, with the surface of the exterior circumference thereof comprising a male threaded member; and, a cut tree reservoir having multiple openings, with interior surface of the openings thereof consisting of female threaded members compatible to the male threaded members of the annular sealing devices, with one or more ports and hoses, according to the various embodiments.
Figure 11:
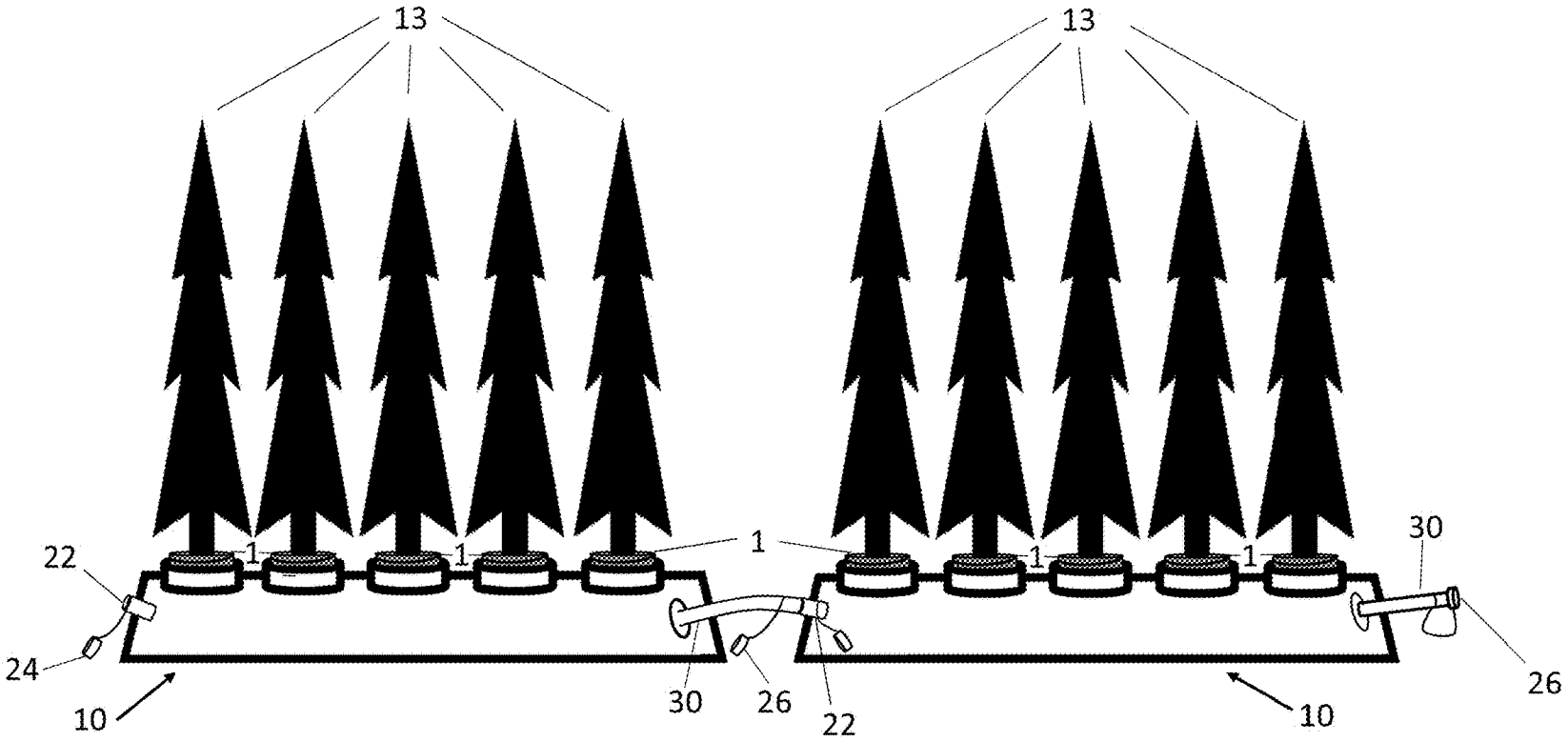
FIG. 11 depicts the annular sealing device of FIG. 4 placed around the circumference of multiple cut tree trunks in closed configurations and sealed tightly against the tree trunks, with the surface of the exterior circumference thereof comprising a male threaded member which is partially threaded into the one or more openings of a plurality of reservoirs, the openings thereof having an interior circumference comprising a female threaded member compatible to the male threaded member of the annular sealing device, with one or more ports and hoses, according to the various embodiments. The multiple reservoirs in FIG. 11 are connected to each other, and so demonstrate that a continuous chain of a plurality of reservoirs may be formed and that the plurality of reservoirs may be filled through a single connection to a service hose at one end of the series, according to various embodiments.

Referring now to FIG. 10 and FIG. 11, which depict in perspective view with some elements in phantom, the installation of a compatible container or reservoir 10 onto the annular sealing device 1 of FIG. 4, which itself has been attached to the trunk of the tree 13 and secured by means of the sealing screw 5, and which forms a water-tight seal by means of compressing the collapsible and impermeable material 15, such as, for example, closed cell foam, between the trunk of the tree 13, and the inner circumference of the annular sealing device 1. The reservoir depicted in FIG. 10 and FIG. 11 is a generally conical container 10 having a floor 12 and side walls 21 tapering upwards to one or more openings 11, wherein the surface of the internal circumference of the opening 11 comprises internal threads 8 that mate with the compatible external threads 7 of the annular sealing device 1. The remaining features and novelties of the reservoir depicted in FIGS. 1-3 obtain to this reservoir, though not enumerated or described herein.

In reference now to FIG. 11, when it is desired to fill a plurality of containers or reservoirs 10 that have been installed onto a plurality of trees 13, an annular sealing device 1 having been affixed to each tree 13 (such as when a plurality of trees are harvested and loaded onto a truck for delivery to distant locations), the hose 30 of one container 10 may be connected to the port 22 of another container 10. A plurality of containers 10 may be thus be connected in this fashion and they may all be filled by attaching a service hose or other means of liquid delivery to the port 22 of the first container 10 in the series, after having removed the cap 24 therefrom, and running the hose water or other liquid, until the containers 10 are filled with the desired amount of liquid and the cap 26 to the last hose 30 in the chain may be used to seal that hose 30 closed.

Although it is expected that construction of the present teachings will use current materials and techniques for making water filled devices for outdoor use, applicant notes that new or alternative materials and methods to create the subject device are anticipated. For example, the container of the present teachings is described as made of a flexible and impermeable material, such as injection-molded vinyl, rubber, a single plastic sheet folded and welded by known plastic welding techniques, or the like. The subject device can be constructed of several sheets of plastic welded together. Plastic and other material types have varying types and thicknesses. Materials used to construct the subject device could include fiber reinforcement. In some situations, welds can be created by glue. Other examples of varied materials and methods include, but are not limited to, using a nylon fabric treated for water resistance to construct the device in which sewing and water-proofing seams may be applicable to the method of creating the subject device. Fluids other than water may work more effectively in the subject device but could require different materials to contain the fluids. While a number of variations of the material and methods to make the claimed invention can be anticipated, it is noted that it is the unique configuration and features of the present teaching that impart its many advantages.

While there has been shown and described various embodiments, it will be apparent to those skilled in the art that other and different applications may be made of the principles of the various embodiments, so the scope of the present teachings are not intended, and should not be construed to be, limited thereby. Various changes and modifications can be made without departing from the scope of the present teachings.

What is claimed is:

1. A harvested tree reservoir comprising: a generally conical container having a floor and side walls tapering upwards to one or more opening to receive a cut trunk of harvested Christmas trees of about 9 to 14 inches in circumference, the walls and floor comprising a flexible and impermeable material, including injection-molded vinyl, rubber, or a single folded and welded plastic sheet, wherein the interior surface of the circumference of said one or more opening comprises internal threads that mate with a member with compatible external threads; one or more ports, with caps or plugs for re-sealing of the ports, located on the sides of the container to fill the container with liquid or let air escape from the container; a hinged annular sealing device comprising a pair of arc-shaped members to rotated between an open and a closed position, wherein the hinged annular sealing device is secured to the trunk of the harvested tree by means of lateral pressure created by a screw running from a proximate end of the hinged annular sealing device into a threaded hole at a distal end of the hinged annular sealing device, wherein the inner circumference of the closed annular sealing device comprises a substantially round opening and the exterior surface of the outer circumference of said annular sealing device comprises external threads that mate with the internal threads of the harvested tree reservoir; and more than one annular lining made of a collapsible, impermeable material, each comprising an inner circumference and an outer circumference; wherein said inside of the opening of the annular sealing device comprises an inner circumference; wherein said outer circumference of said annular lining is substantially the same as the inner circumference of said opening of the annular sealing device; wherein said inner circumference of said one or more annular lining is configured to pass the trunk of a selected tree; and wherein said one or more annular lining comprises a plurality of different inner circumferences for accommodating a plurality of tree trunks of different circumferences and horizontal cross sections, and wherein said one or more annular lining is vertically cut in one or more places to allow installation on an uncut tree trunk, and such that when the sealing device is actuated against the trunk of the tree, and a selected lining from the one or more annular lining is compressed against the surface of the tree trunk, a watertight seal is formed between the tree trunk and an interior of a neck of the one or more opening of the reservoir.

2. The reservoir according to claim 1, wherein one or more of the ports on said container further comprise one or more permanently fixed or detachable hoses to attach one said reservoir to another, when each reservoir is attached to a harvested tree trunk, and caps or plugs to seal an end of the one or more hoses and the one or more ports.

3. The reservoir according to claim 1, further comprising ridges internally located within an inside surface of the bottom of the container to allow the liquid within the container to come into direct contact with the cut end of the tree trunk, when the tree is stood in a vertical position.

4. The reservoir according to claim 1 further comprising one or more holes along the neck of the one or more opening of said container to insert one or more sealant nozzles or tube from canned foam insulation or sealant.

5. The reservoir according to claim 1, further comprising closed cell foam within the reservoir.

6. A harvested tree reservoir comprising: a generally conical container having a floor and side walls tapering upwards to a circular opening into a reservoir that holds a liquid volume, wherein the opening receives a trunk of a harvested Christmas tree and wherein a surface of the reservoir proximate to the opening comprises a threaded portion; at least one port with a cap or plug to reseal the port, wherein the port passes through one of the side walls into the cylindrical shaft to fill the container; and a hinged annular sealing device comprising a pair of arc-shaped members that rotate between an open position and a closed position, wherein the closed position of the sealing device defines a circular ring with an outer surface and an inner surface, a ring of a collapsible and impermeable material attached to the inner surface, and the outer surface comprising a threaded portion that mates with the threaded portion of the shaft; wherein in the closed position the hinged annular sealing device secures the trunk of the harvested tree by means of lateral pressure created by a screw running from a proximate end of the hinged annular sealing device into a threaded hole at a distal end of the hinged annular sealing device thereby forming a watertight seal to contain liquid in the reservoir.

7. The reservoir according to claim 6, wherein the port comprises one or more ports on said container and further comprising one or more permanently fixed or detachable hoses attached to the one or more ports to attach one reservoir to another, when each reservoir is attached to a harvested tree trunk, and caps or plugs to seal an end of the one or more hoses.

* * * * *